US008448384B2

(12) United States Patent
Wernlund et al.

(10) Patent No.: US 8,448,384 B2
(45) Date of Patent: May 28, 2013

(54) DOORWAY WITH DP ENHANCED SILL

(75) Inventors: Chad Wernlund, Baldwin, WI (US); Jon Dekko, Grant, MN (US); Duane Fier, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 449 days.

(21) Appl. No.: 12/472,601

(22) Filed: May 27, 2009

(65) Prior Publication Data

US 2010/0300001 A1 Dec. 2, 2010

(51) Int. Cl.
*E06B 1/70* (2006.01)

(52) U.S. Cl.
USPC ..... 49/471; 52/209

(58) Field of Classification Search
USPC ..... 49/467, 469, 471; 52/209
See application file for complete search history.

(56) References Cited

U.S. PATENT DOCUMENTS 1,429,203 A 9/1922 Hartstra
3,079,653 A 3/1963 Cornell
3,410,027 A * 11/1968 Bates ..... 49/471
3,851,420 A 12/1974 Tibbetts
3,919,815 A 11/1975 Alabaster
4,055,917 A 11/1977 Coller
4,154,033 A 5/1979 Krueger et al.
4,310,991 A 1/1982 Seely
4,467,582 A * 8/1984 Hague ..... 52/478
4,513,536 A 4/1985 Giguere
4,686,793 A 8/1987 Mills
4,715,152 A 12/1987 Tanikawa
4,831,779 A * 5/1989 Kehrli et al. ..... 49/471
5,018,307 A 5/1991 Burrous et al.
5,067,279 A 11/1991 Hagemeyer
5,123,212 A 6/1992 Dallaire et al.
5,136,814 A * 8/1992 Headrick ..... 49/468
5,179,804 A 1/1993 Young
5,373,671 A 12/1994 Roth et al.
5,687,508 A 11/1997 Fitzhenry et al.
5,887,387 A 3/1999 Dallaire
5,890,331 A 4/1999 Hope
5,956,909 A 9/1999 Chou
6,044,600 A 4/2000 McCollough
6,076,310 A 6/2000 Kim
6,098,343 A 8/2000 Brown et al.
6,276,099 B1 8/2001 O'Shea
6,334,283 B1 * 1/2002 Edger ..... 52/204.1
6,763,639 B2 7/2004 Bennett et al.
6,789,359 B2 9/2004 Bauman et al.

(Continued)

*Primary Examiner* — Katherine Mitchell
*Assistant Examiner* — Catherine A Kelly
(74) *Attorney, Agent, or Firm* — Womble Carlyle Sandridge & Rice, LLP

(57) ABSTRACT

A doorway with a sill attachment that increases a sill DP rating includes spaced vertical jambs, a head jamb, and a sill, all of which form a door frame, and a door panel mounted in the frame. The sill is a substantially hollow contain-and-drain type sill with a nosing provided with drainage openings. a substantially hollow sill attachment is mounted to and extends along the nosing and the attachment projects downwardly to a position below the openings in the nosing of the sill. The drainage openings communicate with the interior of the extension. Weep holes that communicate with the environment are located in the sill attachment at a position below the openings in the nosing of the sill. The sill and sill attachment may be formed as a single component, or as separate components assembled either in the factory or the field. The attachment increases a column height of water that can be accommodated by the sill before leakage occurs, and thus enhances the DP rating of the sill.

11 Claims, 4 Drawing Sheets

U.S. PATENT DOCUMENTS

| | | | | |
|---|---|---|---|---|
| 6,848,225 | B2 | 2/2005 | Lapierre | |
| 6,883,279 | B2 | 4/2005 | Fukuro et al. | |
| 7,574,829 | B1 * | 8/2009 | Prager | 49/408 |
| 7,669,369 | B2 | 3/2010 | Henry et al. | |
| 2002/0194788 | A1 | 12/2002 | Bennett | |
| 2003/0106269 | A1 | 6/2003 | Bauman et al. | |
| 2005/0055912 | A1 | 3/2005 | Teodorovich | |
| 2006/0080902 | A1 | 4/2006 | Bren | |
| 2006/0150521 | A1 | 7/2006 | Henry et al. | |
| 2008/0110100 | A1 * | 5/2008 | Heppner | 49/471 |

* cited by examiner

DOORWAY WITH DP ENHANCED SILL

TECHNICAL FIELD

This disclosure relates generally to doorway sills and more specifically to doorways with contain-and-drain sills that include features to increase the sill design pressure, or the sill "DP."

BACKGROUND

Entry doors, patio doors, and the like generally include a pair of spaced vertical side jambs and a door sill extending between the bottom ends of the side jambs to form a portion of a door frame. Hinged or sliding door panels are mounted within the resulting frame and, when closed, directly overly a threshold portion along the inside of the sill. Many hinged entry doors open into a building in which they are mounted and thus are know as in-swing doors. A variety of sill configurations are available for use with entry doors including wooden sills, aluminum sills, plastic sills, composite sills, and the like.

One type of sill used for entry doors is known as a "contain-and-drain" sill. In general, a contain-and-drain sill typically is extruded from plastic, aluminum, or a composite material and is generally hollow inside with, perhaps, some longitudinal support ribs, which form chambers inside the sill. Openings are formed in the support ribs enabling communication of fluids between adjacent chambers. The ends of the sill are sealed with an end cap and one or more weep holes are formed along an outside nosing of the sill and communicate between the hollow interior and the outside environment. The weep holes may be provided with weep doors or flaps. Drains are generally arranged on the threshold of the sill and function as portals for water to flow from the threshold into the hollow interior of the sill. Once within the interior of the sill, water can drain from the sill and through the weep holes to the outside. Additionally, such drains also function as vents helping to equalize pressure differentials that develop at times between the outside of a doorway and the inside of a building and to vent air displaced by rising water in the sill.

Rainstorms are sometimes accompanied by very high winds that can raise the air pressure on the exterior of a doorway relative to the interior of the doorway, creating a partial vacuum within the hollow interior of a contain-and-drain door sill. As used herein, the term "partial vacuum" means that there exists a negative pressure differential between the outside of the doorway and the hollow interior of the door sill. The partial vacuum can cause rain water to be sucked through weep holes along the outside nosing of the sill and into the interior of the sill, causing the sill to fill progressively with water. A relationship exists between the magnitude of the partial vacuum and the height of the column of water, which establishes a head of water pressure within the sill. The water in the sill generally rises until the head of water pressure is balanced by the pressure differential between the outside and inside of the doorway. Often, and particularly in driving rains, there also is collected water on the threshold portion of the sill draining into the interior of the sill. If the winds are extreme enough, causing the partial vacuum to increase sufficiently, the water level within the sill can rise to a level that exceeds the capacity of the sill, forcing the water to escape. The water generally does so through the drains in the threshold and elsewhere and pools on an upper surface of the sill. The pooling water has an increased likelihood of entering the dwelling and causing water damage. Leakage into a dwelling can cause the doorway to fail to meet building standards for water resistance, particularly in hurricane prone regions such as coastal areas.

The DP rating of a door sill is based on laboratory pressure testing and is measured in pounds per square foot, or psf. Generally speaking, the DP rating is a measure that is a function of a height of a column of water the contain-and-drain sill can accommodate under blowing rain conditions before the sill fills and begins to leak. The greater the height of the water column the sill can contain under wind generated pressure, the larger the DP rating. A typical contain-and-drain door sill may have a DP rating of about 35 to 40. Sills with such ratings, while adequate in most regions, can be inadequate in areas such as coastal regions that are prone to tropical storms and hurricanes where rain is accompanied by exceedingly high wind conditions.

A need therefore exists for n doorway with a contain-and-drain sill that effectively contains and allows a greater head of water to be established within the sill under high wind load conditions without leaking and that drains water effectively from the sill under normal rainy conditions. It is to the provision of such a doorway that the present disclosure is primarily directed.

SUMMARY

Briefly described, the present invention, in a preferred embodiment thereof, is a doorway with a contain-and-drain door sill extending between a pair of spaced vertical side jambs of a door frame. The door sill has a generally hollow interior and is sealed at its ends forming a chamber inside. The sill includes a nosing having a plurality of drainage openings allowing water that collects in the chamber of the sill to flow out of the sill chamber. A sill extension is mounted to and extends along the nosing of the sill and extends downwardly therefrom a predetermined distance below the drainage openings. The extension is generally hollow with sealed ends and receives water that drains through the openings of the sill. Weep holes are formed along the bottom portion of the sill extension to permit water collected in the sill extension to drain out of the extension and away from the doorway. The weep holes are positioned lower than the drainage openings along the nosing of the sill. The sill further has a threshold portion that generally underlies a closed door panel of the doorway. Drains can be arranged on the threshold portion and can be configured to drain into the interior chamber. Water that may seep past weather seals, result from melting snow or rain, or otherwise make its way to the threshold potion of the sill passes through the drains and into the sill's interior chamber. Drains at other locations on the sill also may permit collected water on the sill to drain into the chamber of the sill.

When the doorway is under DP load in a blowing rainstorm, the pressure on the outside of the doorway rises above that on the inside and creates a partial vacuum inside the sill, which tends to suck water into the sill extension through the weep holes. As the wind speed increases, a column of water proportional in height to the wind speed rises in the sill extension until it reaches the drainage openings in the sill nosing. Further increasing wind speed and partial vacuum causes the rising water to flow through the drainage openings into the interior chamber of the sill, where the height of the water continues to rise, its head balancing the pressure differential creating by the blowing wind. However, unlike a traditional contain-and-drain sill, the total head of water generated is now proportional to the height of the water column in the sill chamber plus the height of the water column in the downwardly extending sill extension. As a result, a sill according to the present disclosure will withstand significantly higher winds before water fills the sill chamber and leaks into a dwelling. As a result, the doorway of this disclosure withstands significantly higher DP loading and thus can be given a higher DP rating.

Accordingly, a doorway with contain-and-drain sill is provided that addresses successfully the problems and shortcomings of the prior art by exhibiting a significantly higher tolerance to DP loads and thus carrying a higher DP rating. This is accomplished by the addition of a nosing extension that mounts to and extends along the nosing of a traditional contain-and-drain sill with weep holes below the openings along the sill nosing. These and other features, objects, and advantages of the embodiments disclosed will be better understood upon review of the detailed description presented below taken in conjunction with the accompanying drawing figures, which are briefly described as follows.

BRIEF DESCRIPTION OF THE DRAWINGS

The present invention is now described with respect to the embodiments illustrated in following drawings. According to common practice, the various features of the drawings discussed below are not necessarily drawn to scale. Dimensions of various features and elements in the drawings may be expanded or reduced to illustrate more clearly the embodiments of the disclosure.

DETAILED DESCRIPTION

Figure 1:
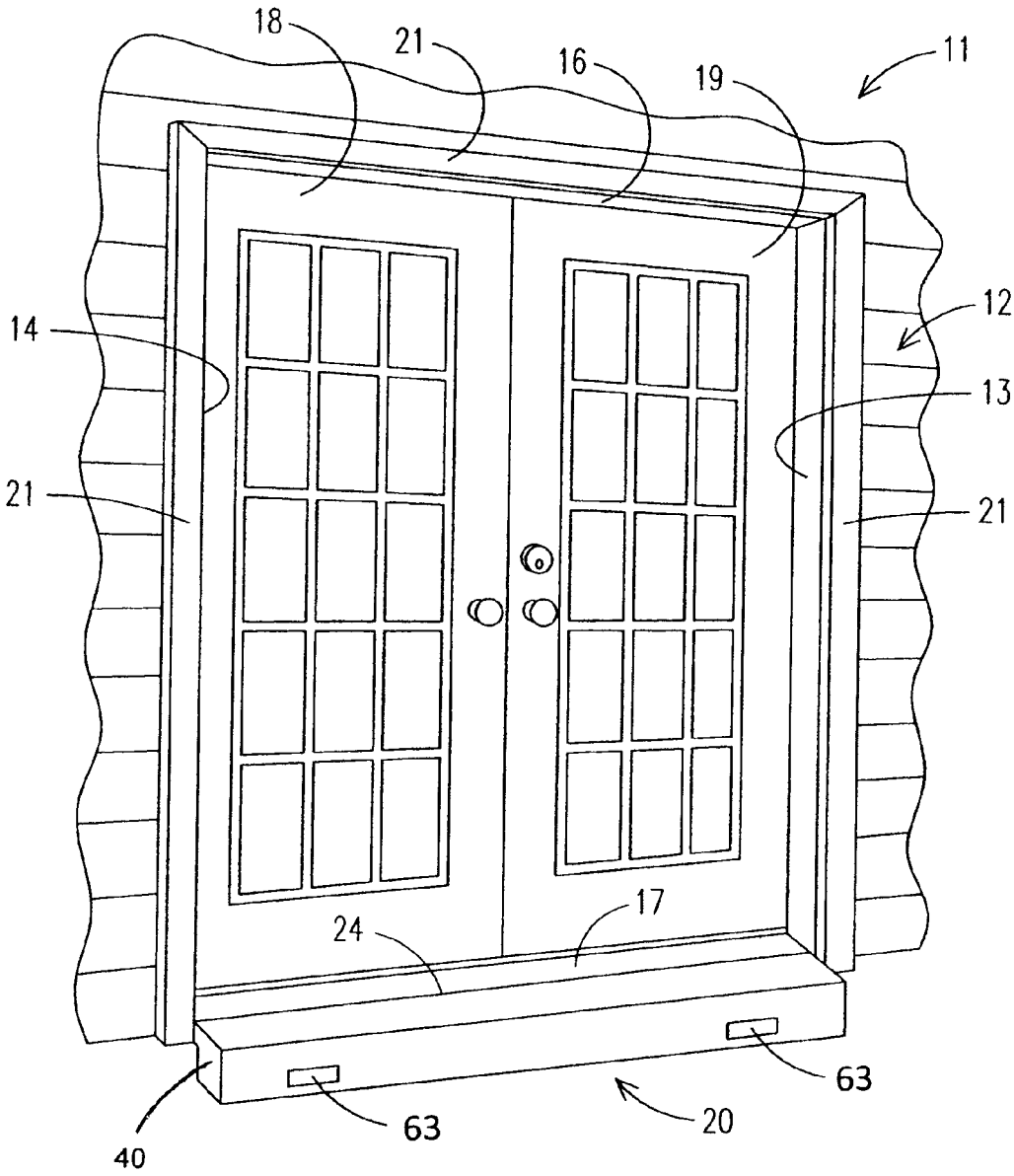
FIG. 1 is a perspective view of a doorway that embodies principles of the invention in one form.

Referring now in more detail to the drawing figures, wherein like reference numerals indicate like parts throughout the several views, FIG. 1 illustrates a doorway that embodies principles of the invention in one form. The doorway 11 is installed in a wall 12 of a building structure and has spaced vertical side jambs 13 and 14 spanned at their top ends by a horizontal head jamb 16. An elongated sill 17, which is of the substantially hollow contain-and-drain type, spans the bottom ends of the side jambs 13 and 14 and has an outside edge or nosing 22. A sill extension 20 is mounted to and extends along the nosing 22 and projects slightly away from the doorway 11 and downwardly below the nosing 22. The sill extension 20 is elongated and substantially hollow and in one embodiment is extruded as a single unitary piece. Weep holes 63 are formed along the sill extension 20 and communicate with the hollow interior of the sill extension to facilitate drainage of water from inside the sill extension to the outside environment. Weep doors or flaps may be associated with the weep holes 63 and are designed to close in the presence of high wind to prevent too much wind and water from blowing directly into the weep holes 63. Such flaps are somewhat, but typically not completely, effective.

Door panels 18 and 19 are hingedly mounted to the side jambs 14 and 13 respectively and are shown in their closed configurations with the bottom edges of the doors directly overlying a threshold portion 27 (FIG. 2) along the inside of the sill 17. The doors 18 and 19 open and swing inwardly into the dwelling and thus are referred to as in-swing doors. While double French in-swing doors are illustrated in FIG. 1, other doorway configurations such as a single entry door, a sidelight door, bi-fold opening doors, a patio door, out-swing doors, gliders, or otherwise also may be used with and benefit from the present invention.

Figure 2:
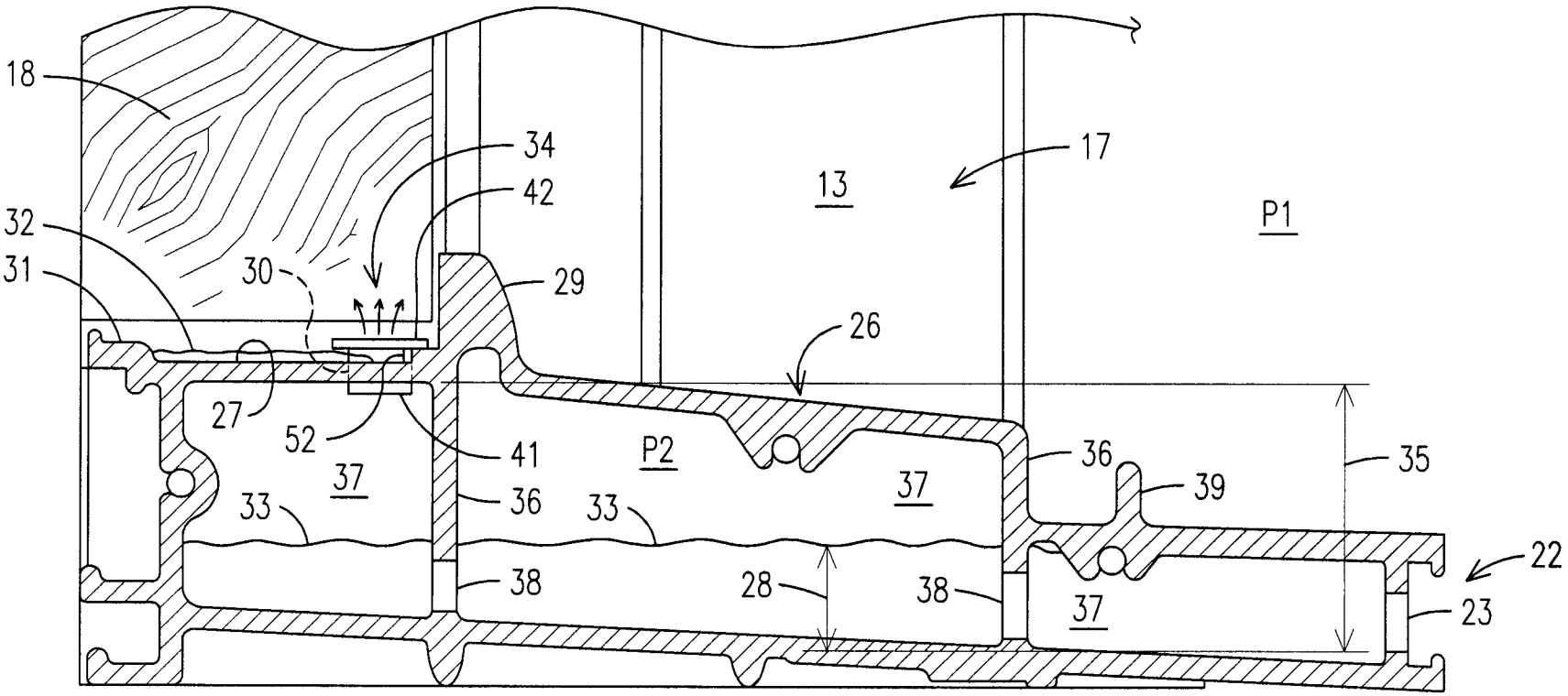
FIG. 2 (PRIOR ART)
FIG. 2 is a cross-sectional view of a section of a traditional contain-and-drain sill illustrating the sill and the internal features of the sill.

FIG. 2 illustrates a traditional contain-and-drain sill configuration and shows the sill 17 and a portion of a side jamb 13 to which it is connected. Closed door panel 18 is shown overlying a threshold portion 27 of the sill. The sill 17 has an exterior sill deck 26 and the threshold portion 27 extends along the interior of the sill 17; that is, the portion of the sill nearest the interior of the dwelling. The sill deck 26 and threshold portion 27 are separated by an upstanding weather seal surface 29, which may be provided with a weather strip, against which the door panel closes. The threshold portion 27 is bounded along the extreme interior edge of the sill 17 by a slightly upstanding lip or rim 31 that is a bit higher than the floor of the threshold portion 27. A second rim or lip 39 is also arranged on the sill deck 26 and functions at least as a guide for a sliding door, perhaps a screen door. Various other profiles and configurations are known in the art, that of FIG. 2 being only exemplary.

The interior of the sill 17 is extruded or otherwise formed with support ribs 36 that define within the sill 17 a number of chambers 37. Additionally, the support ribs 36 function to strengthen the sill 17 by increasing the overall modulus, making the sill 17 more rigid. Openings 38 are formed along the support ribs 36 and establish fluid communication and flow paths from the interior most chamber 37, beneath the threshold portion 27, to a nosing 22 of the sill 17 where weep holes 23 are located. The nosing 22 is generally understood by the skilled artisan to be the outermost edge portion of the sill 17 and can be configured to accept accessories such as sill width extenders or decorative trims. The openings 38 are arranged such that when moving from the lip or rim 31 towards the weep holes 23, each successive opening 38 is vertically lower than the previous opening 38. Thus, water within the interior of the sill 17 can flow freely from any chamber 37 to the exterior nosing 22 and drain out through the weep holes 23.

The floor of the threshold portion 27 is formed with an opening 30 that may receive and hold a drain insert 41. The drain insert 41 extends through the opening 30 and into the chamber 37 below. Standoffs 52 may rest on the floor of the threshold portion 27 of the sill to support the top cover 42 of the insert above and spaced from the floor. Alternatively, the rim of the top cover may simply rest on the floor of the threshold portion 27.

FIG. 2 depicts the traditional contain-and-drain sill 17 as it might appear during a blowing rainstorm. Under these conditions, as discussed above, a pressure differential generally arises between the inside of the doorway and the outside, which creates a partial vacuum within the interior of the sill 17 with an interior pressure P2 being lower than an exterior pressure P1. This, in turn, can suck rainwater 33 into the interior of the sill through the weep holes 23. The level of the water 33 rises within the sill 17 until the water column 28 exerts a head of pressure that balances the difference in pressure between the inside and outside of the doorway. As the wind increases in speed and the partial vacuum within the sill increases, the water column 28 increases as well. If the wind speed and consequential pressure differential is great enough, the water column 28 will increase to a maximum height 35, which corresponds to the interior volume of the sill. Once the maximum water column 35 has been reached, water 34 can exit through the drain inserts 41 and puddle in a pool 32 atop the threshold 27, possibly entering the dwelling, and certainly entering the dwelling if the threshold 27 overflows. At the same time, relatively smaller volumes of water can leak between the door panel 18 and the weather seals against which it is closed. This water also collects in the pool 32 on the threshold portion 27 but is unable to drain into the interior of the sill 17, increasing the likelihood that water will leak into the dwelling.

Figure 3:
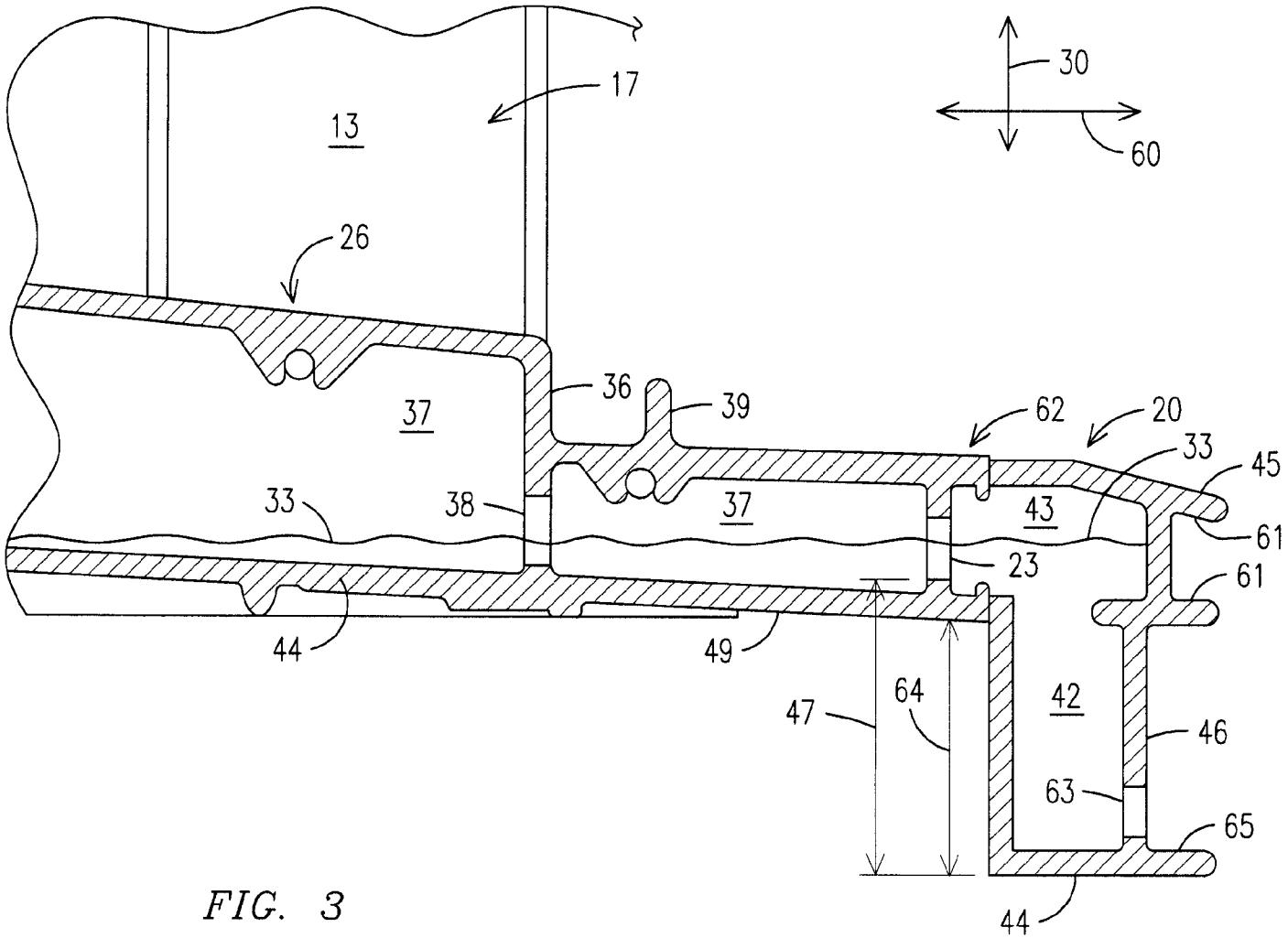
FIG. 3 is a cross-sectional view of a section of a contain-and-drain sill that includes a sill extension integral with the sill and configured according to one embodiment of the invention.

Turning now to FIG. 3, wherein a portion of a contain-and-drain sill 17 is illustrated in cross section, one embodiment of the invention will be discussed. In general, the sill 17 is an elongated hollow structure that extends between the two door jambs 13, 14 of a doorway. The sill 17 includes a sill extension 20 mounted to, extending along, and integral with the nosing of the sill 17. The sill extension 20 projects outwardly from the nosing and away from the sill 17 in a generally horizontal direction 60 a sufficient distance to be beyond any framing and trim beneath the sill. The sill extension 20 also extends downwardly in a generally vertical direction 30, to a position below a sill lower surface 49 for a predetermined vertical distance 64. The vertical distance 64 is determined during the design of the sill extension 17 and can have different values depending on the environment in which a particular sill 17 is to be used. For example, if a sill 17 is to be used in a geographic region known to experience violent weather patterns producing high winds and rain, such as a coastal region where hurricanes are common, the vertical distance 64 of the sill extension 20 can be greater than other geographic regions less prone to high winds and rain.

The sill extension 20 is a generally hollow structure having an internal cavity or chamber 43 with end caps 40, shown in FIG. 1, to create a substantially closed interior 42. The chamber 43 is in communication with the sill inner chambers 37 via openings 38 in support ribs 36 (which correspond to weep holes in a traditional sill). Together, the sill 17 and sill extension 20 form a flow path that enables water to flow from drains in the threshold (see FIG. 2), through openings 38 in support ribs 36, into the sill extension chamber 43, and exit to the environment through weep holes 63 arranged in an outer surface 46 of the sill extension 20. Weep holes 63 are located in the outer wall 46 of the sill extension 20 below the sill base 49 to be vertically lower than the openings 38. The weep holes 63 are generally located as close to a bottom surface 65 of the sill extension 20 as possible and sized as necessary to ensure proper water flow so the sill 17 drains adequately during normal rainy conditions. By doing so, a distance 47 between the weep hole 63 and the opening 38 is maximized. The distance 47 represents the increase in water column height that is achieved with the addition of the sill extension 20. A sill extension nosing 45 may be arranged toward a far end of the sill extension 20 and can incorporate features 61 that, at a minimum, improve strength, performance, and appearance of the extension.

As illustrated in FIG. 3, the sill 17 and sill extension 20 are, in this embodiment, an integral component; i.e., the sill 17 and sill extension 20 are fabricated as a single extruded piece. The sill 17 and sill extension 20 are comprised of a plurality of interconnected structural members 44. Collectively, the structural members 44 define the boundaries and cavities of the sill 17 and sill extension 20 and are arranged so as to provide a continuous flow path for collected water to exit to the environment. The wall thicknesses of the structural members 44 are predetermined to provide adequate rigidity and strength for resistance that will occur during the normal life and use of the component. The wall thickness of each member 44 can vary depending on location within the structure and the function of the particular member 44. For example, structural members 44 of the sill deck 26 may be thicker than those of the lower surface 49 to withstand the weight of an average adult. Additionally, there is no requirement that a thickness of a given member 44 have a constant thickness or a constant cross section.

The sill 17 and sill extension 20 can be produced from any acceptable material, or combination of materials. Plastics and composites are considered to be ideal because they have malleable characteristics and lend themselves to a wide variety of manufacturing techniques, such as extrusion and injection molding to name but a few. Plastics and composites are also resistant to degradation from the elements, such as rotting, rusting, or warping. Other materials, such as metals and alloys, can be used to fabricate the sill 17 and sill extension 20 if desired.

Figure 4:
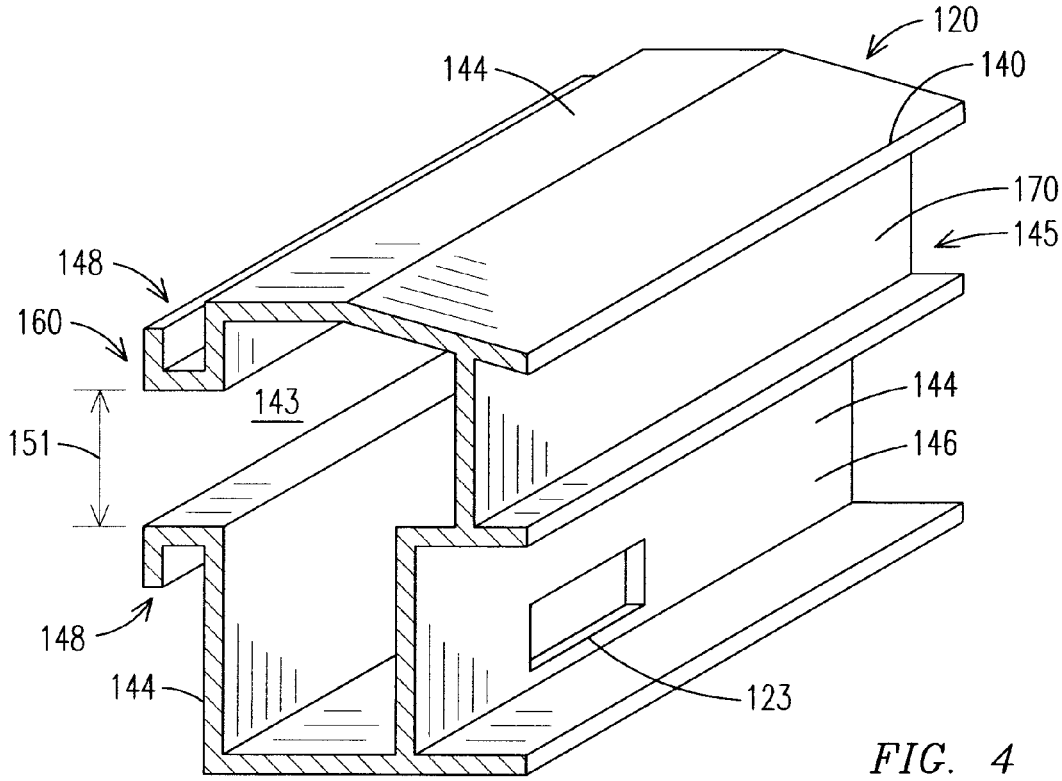
FIG. 4 is a perspective view of a sill attachment according to another embodiment of the invention.
Figure 5:
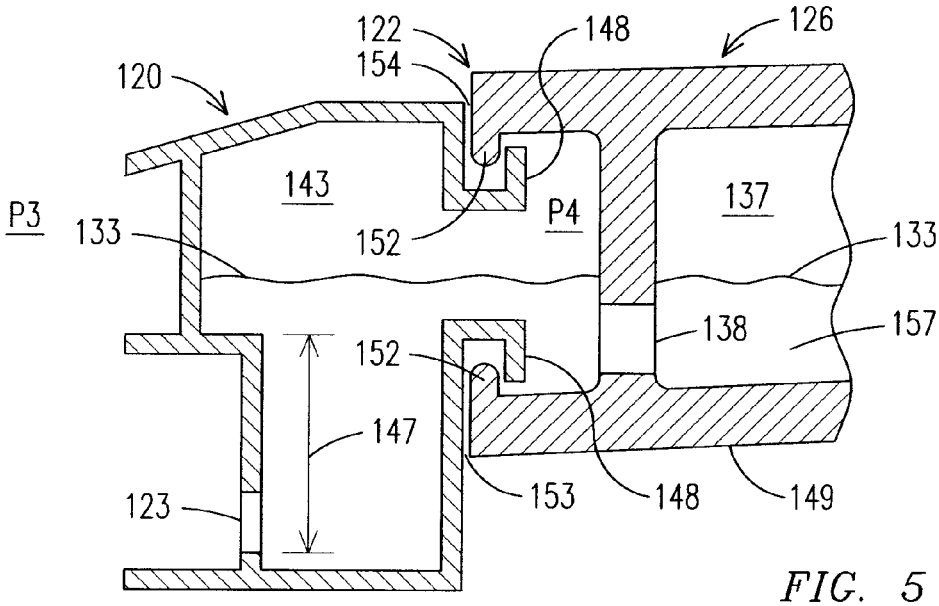
FIG. 5 is a cross-sectional view of the sill attachment of FIG. 4 attached to a sill and includes details of the sill that may be present during a blowing rainstorm.

FIGS. 4 and 5 illustrate another embodiment of the sill of this invention. In FIG. 4, the sill extension 120 is fabricated as a separate element for installation on a traditional contain-and-drain sill either in the factory or in the field. The sill extension 120 is configured to mounted to and extend along a sill nosing 22 (see FIG. 2) of a sill. More specifically, attachment clips 148 are formed along an inside surface of the sill extension 120. As detailed below, these clips are configured to be snapped onto the nosing of a traditional sill to attach the extension 120 thereto. The sill extension 120 is a generally hollow structure having a hollow interior chamber 143 and has a length 140 that is approximately the same length of a sill to which it is to be attached. Weep holes 123 (only one of which is visible in FIG. 4) are arranged low and in an outer surface 146 of the sill extension 120 establishing fluid communication between the environment and the hollow interior chamber 143 and establishing a path through which water can drain to the environment. The size of weep holes 123 is predetermined to provide adequate drainage from within the sill extension 120 under normal rainy conditions. An end cap 40, shown in FIG. 1, attaches to each end of the sill extension 120 forming a substantially closed chamber and preventing water from flowing out of the ends of the extension. Water enters the sill extension cavity 143 through an opening 151, which is located and defined between the attachment clips 148 that attach to the nosing of a sill. The opening 151 can extend along a portion of, or along the entire length 140 of the sill extension 120. The sill extension 120 further comprises a sill extension nosing 145, which provides structural rigidity and strength while improving the appearance of the sill extension 120.

Referring to FIG. 5, the attachment clips 148 are shaped to attach to a common nosing structure of sills, but may be any means of attachment that will adequately secure the sill extension 120 to the nosing. For example, the sill extension 120 may be attached to the nosing by mechanical means such as screws, rivets, fasteners, welded bonds, an interference fit between components, and features of the sill extension 120 and sill 126 other than clips that interlock. Chemical bonding means such as glues, resins, epoxies, and the like may also be used as a means of attaching the sill extension 120 to the sill 126. The attachment clips 148 in the present embodiment are illustrated as opposing "C" shaped features bounding the opening 151. As can be seen in FIG. 5, the nosing of the sill 126 has attachment features 152 integrated into the nosing 122 configured so that the attachment clips 148 of the sill extension 120 engage and lock onto the attachment features 152 in a "snap-on" fashion. The attachment features 152 typically are provided for attaching accessories such as sill width extenders for fabricating wider sills, but are ideal for attaching a sill extensions for draining purposes according to the present disclosure. Wall 170 of the sill extension 120 should be flexible enough to allow attachment means 148 to elastically deform and engage with attachment features 152 of the sill 126 and return to approximately its original shape. When assembled, the sill 126 and sill extension 120 form a structure that is substantially water-tight and is intended to function the same as the integral sill and sill extension discussed in connection with FIG. 3. Caulking or silicone can be applied at locations 153, 154 of an interface between the sill extension 120 and the sill 126 to enhance the water-tight seal between the two components as well as improve the attachment between the two components.

The sill 126 and sill extension 120 of FIGS. 4 and 5 can be produced or manufactured from a variety of materials, included plastics or polymers, composites, metals, or alloys. Material selection may depend on the application and cost of manufacture. It is preferable that the sill 126 and sill extension 120 be manufactured from the same material, however, this is not a requirement. There is no limitation on the manufacturing method or techniques that can used to produce the sill 126 and the sill extension 120 and the most appropriate method may be selected depending on material used or costs associated with manufacture. For example, if a plastic is to be used for manufacture, an injection molding or extrusion manufacturing processes can be the most appropriate manufacturing method.

With continued reference to FIG. 5, the sill 126 and sill extension 120 are depicted as they might appear during a rainstorm having blowing winds. Under these conditions, a pressure differential arises between the inside of the doorway and the outside creating a partial vacuum within the sill extension chamber 143 and sill chamber 137. An external pressure P3 exists and is greater than a pressure P4 that is internal to the sill 126 and sill extension 120. The pressure differential, P3-P4, which is brought about by the driving winds in a storm, creates the partial vacuum. This in turn tends to suck rainwater 156 into the sill 126 and sill extension 120 through weep holes 123, creating a volume of water 157 inside the hollow structure. This is a situation that, with reference to the prior art of FIG. 2, could result with a traditional contain-and-drain sill in water filling the sill and causing water 34 to exit out of the sill 26 through the threshold drains, ultimately resulting in leakage into a dwelling.

With the conditions depicted in FIG. 5 thus described, the function of the sill extension 120 to increase the DP load tolerance of a sill will now be described. A vertical distance 147 is established between the weep holes 123 and an opening 138 (which may be a weep hole of the traditional sill). The vertical distance 147, when combined with the maximum water column height that can be accommodated by the sill 17 will result in a new maximum water column height, which is the sum of the maximum water column height of the sill 17 and the vertical distance 147. Thus, the combination sill with extension can now accommodate a greater water column and thus a greater head of water pressure before water seeps through the threshold drains. Accordingly, correspondingly higher wind conditions can be withstood before leakage into the dwelling occurs. As a result, the DP rating of the sill is increased. With this improved configuration, it has been found that the DP of the sill can be increased from 35 or 40 to 60, and possibly higher, by simply appropriately establishing the vertical distance 147. By doing so, the head of water that can be accommodated by the sill is increased in proportion to the vertical distance 147. Furthermore, the sill 126 with sill extension 120 can adequately drain water to the environment during normal rainy conditions where there is insufficient wind to cause water to begin to rise within the sill and extension.

The invention has been described above in terms of preferred embodiments and methodologies that represent the best mode known to the inventors of carrying out the invention. Skilled artisans will recognize, however, that the invention can be embodied in a variety of different forms and configurations without departing from the scope of the invention. Sill extensions for contain-and-drain sills, for instance, can be formed in a range of configurations and sizes and from a variety of materials. While the invention has been described within the context of an in-swing door, it may be also be applicable to out-swing doors as well as sliding and bi-folding doors. The embodiments of the invention may be applied to windows and window sills as well as doorways. These and other additions, deletions, and modifications to the illustrated embodiments might well be made by those of skill in the art without departing from the spirit and scope of the invention as set forth in the claims.

What is claimed is:

1. A contain-and-drain sill comprising:

a sill body having a threshold cap positioned to underlie a closed door of an entryway in which the contain-and-drain sill is installed and defining a generally hollow sill interior, the sill body having an exterior edge defining a nosing;

the nosing including first and second attachment features extending along the length of the nosing;

the nosing being spaced from the threshold cap a distance sufficient to ensure that the first and second attachment features of the nosing are positioned beyond framing and trim beneath an opening in which the contain-and-drain sill is installed;

a separate sill extension attached to the nosing and extending from the nosing of the sill body to a position below the sill body, the sill extension having a generally hollow sill extension interior, opposed ends, a first clip engaged with the first attachment feature of the nosing forming a first interface between the sill nosing and the sill extension and a second clip engaged with the second attachment feature of the nosing forming a second interface between the sill nosing and the sill extension;

caulking or silicone along the first interface formed by the first clip and the first attachment feature and forming a substantially watertight seal;

caulking or silicone along the second interface formed by the second clip and the second attachment feature and forming a substantially watertight seal;

a first end cap attached to one end of the sill extension, the first end cap closing the one end and forming a substantially watertight seal at the one end of the hollow sill extension interior;

a second end cap attached to the opposed end of the sill extension, the second end cap closing the opposed end and forming a substantially watertight seal at the opposed end of the hollow sill extension interior;

at least one opening in the nosing between the first and second attachment features and establishing a flow path between the generally hollow sill interior and the generally hollow sill extension interior; and at least one weep hole in the sill extension below the level of the at least one opening in the nosing and establishing a flow path between the generally hollow sill extension interior and a environment.

2. The sill of claim 1, wherein a plurality of weep holes are formed in the sill extension.

3. The sill of claim 1, wherein the sill extension and the sill are each produced from a material selected from the group of materials consisting of a plastic, a composite, a metal, an alloy, a polymer, and combinations thereof.

4. The sill of claim 1, wherein the weep hole in the sill extension is positioned to increase the DP rating of the sill by at least 20%.

5. A contain and drain sill as claimed in claim 1 wherein the first and second attachment features extend inwardly toward each other forming a space therebetween and the first and second attachment clips extend away from each other and are sized to receive the first and second attachment features respectively.

6. A contain and drain sill as claimed in claim 5 wherein the extension is sufficiently flexible to deform and allow the first and second attachment features to engage with the first and second attachment clips and then to return approximately to the original shape of the extension.

7. A doorway comprising:

a pair of spaced apart vertical jambs spanned at their tops by a head jamb and spanned at their bottoms by a sill to form a door frame;

a door panel mounted within the door frame;

the sill having a threshold positioned to underlie the door panel when closed, a substantially hollow sill interior, a sill deck, and a nosing extending along an exterior edge of the sill deck with at least one opening being formed in the nosing communicating with the sill interior;

the nosing being spaced from the threshold a distance sufficient to locate the nosing at least partially beyond an edge of underlying subfloor of a roughed-in opening when the doorway is installed in the opening;

a first attachment feature projecting from the nosing and a second attachment feature projecting from the nosing;

an extension mounted to and extending along the nosing, the extension having a substantially hollow extension interior with opposed ends and extending to a position below the sill, the opening communicating with the substantially hollow extension interior;

the extension having a first attachment clip mechanically engaged with the first attachment feature of the nosing and defining a first interface between the sill nosing and the sill extension and a second attachment clip mechanically engaged with the second attachment feature of the nosing and defining a second interface between the sill nosing and the sill extension;

caulking or silicone forming a substantially watertight seal between along the first interface formed by the first attachment clip and the first attachment feature and caulking or silicone forming a substantially watertight seal along the second interface formed by the second attachment clip and the second attachment feature;

end caps at the opposed ends of the substantially hollow sill extension interior closing the chamber and forming a substantially watertight seal;

the at least one opening in the nosing of the sill being spaced between the first attachment clip and the second attachment clip; and at least one weep hole formed in the extension below the level of the at least one opening in the sill nosing, the weep hole communicating with an environment.

8. The doorway of claim 7 and wherein the at least one weep hole is located sufficiently below the opening to increase a DP rating of the doorway.

9. The doorway of claim 8 and wherein the at least one weep hole is located sufficiently below the opening to increase a DP rating of the doorway by at least 20%.

10. A doorway as claimed in claim 7 wherein the first and second attachment features extend inwardly toward each other forming a space therebetween and the first and second attachment clips extend away from each other and are sized to receive the first and second attachment features respectively.

11. A doorway as claimed in claim 10 wherein the extension is sufficiently flexible to allow engagement of the first and second attachment features with the first and second attachment clips.

* * * * *